United States Patent [19]

Mirhej

[11] 4,157,419

[45] Jun. 5, 1979

[54] POLYESTER FEED YARN FOR DRAW-TEXTURING

[75] Inventor: Michael E. Mirhej, Signal Mountain, Tenn.

[73] Assignee: E. I. Du Pont de Nemours and Company, Wilmington, Del.

[21] Appl. No.: 833,911

[22] Filed: Sep. 16, 1977

[51] Int. Cl.[2] ..... D02G 3/00

[52] U.S. Cl. ..... 428/373; 57/245; 428/364; 428/369; 428/370; 428/371; 428/374

[58] Field of Search ..... 428/364, 373, 374, 369, 428/370, 371; 57/140 BY

[56] References Cited

U.S. PATENT DOCUMENTS

| | | | |
|---|---|---|---|
| 3,137,991 | 6/1964 | Fairley | 57/160 |
| 3,397,426 | 8/1968 | Fujita et al. | 425/131.5 |
| 3,546,328 | 12/1970 | Lodge et al. | 264/171 |
| 3,616,634 | 11/1971 | Tomiita et al. | 428/374 |
| 3,857,232 | 12/1974 | Heinrich et al. | 57/157 R |
| 3,857,233 | 12/1974 | Cardinal et al. | 57/157 R |
| 3,987,614 | 10/1976 | Cardinal et al. | 57/140 BY |
| 3,998,042 | 12/1976 | Reese | 57/140 BY |
| 4,019,311 | 4/1977 | Schippers | 57/140 BY |
| 4,059,949 | 11/1977 | Lee | 57/140 BY |

FOREIGN PATENT DOCUMENTS

| | | | |
|---|---|---|---|
| 47-16157 | 11/1972 | Japan | 57/140 BY |
| 49-124329 | 11/1974 | Japan | 428/373 |
| 1130996 | 10/1968 | United Kingdom | 57/140 BY |
| 1420076 | 1/1976 | United Kingdom | 57/140 BY |

*Primary Examiner*—Lorraine T. Kendell

[57] ABSTRACT

Polyester feed yarn for drawtexturing, having an elongation at break of 30 to 150 percent, is composed of three different types of filaments. (A) 20 to 40 percent of the filaments consist of a polymer of ethylene terephthalate and 0 to 3 mole percent of modifying groups for imparting cationic dyeability. (B) 20 to 40 percent of the filaments consist of a copolymer of ethylene terephthalate and about 5 to 15 mole percent of other ester units. (C) 15 to 35 weight percent of the yarn consists of eccentric bicomponent filaments of the above two polymers. The bicomponent filaments have a smaller denier and lower elongation at break than the other filaments, so that the bicomponent filaments can be broken preferentially when the yarn is drawtextured to provide spun-like tactility. When broken, the bicomponent filaments helically crimp and become entangled in the yarn bundle with a slight, uniform protrusion of ends above the surface which provides good resistance to pilling in fabrics.

8 Claims, 2 Drawing Figures

POLYESTER FEED YARN FOR DRAW-TEXTURING

BACKGROUND OF THE INVENTION

This invention relates to a polyester feed yarn for drawtexturing, and is more particularly concerned with yarn of three different types of filaments, one being of a type which can be preferentially broken in drawtexturing to provide a spun-like textured yarn.

Direct-spinning processes in which continuous filaments are stretch-broken to produce spun yarns are well known as illustrated by Field, Jr. U.S. Pat. No. 3,487,619. Schippers U.S. Pat. No. 4,019,311 discloses melt-spinning and orienting two different polymers simultaneously to produce a yarn of filaments having different elongations at break, and then stretching the yarn to break the lower elongation filaments and produce a spun-like yarn. However, Cardinal et al. U.S. Pat. No. 3,987,614 teaches that a yarn composed of filaments differing in break elongation is not suitable for a simultaneous drawing and texturizing process, because the filament breakage occurs in the drawing zone at the beginning of the heater and the loose ends repeatedly jam the twister of the texturizing machine (e.g., the false-twist spindle). The Cardinal et al. invention is a yarn composed of two types of filaments, wherein one type has a flex abrasion resistance of less than 1500 cycles and breaks at irregular intervals due to the transverse stress applied in the texturizing zone of the machine. Example 1 discloses production of such yarn by cospinning two polymers from the same spinneret to produce a yarn of two types of filaments having elongations at break of 310 and 375 percent. The yarn was drawtextured at a draw ratio of 1:2.90, followed by interlacing of loose filament ends into the yarn. The broken ends showed a flex abrasion resistance of 350 cycles.

Lodge et al. U.S. Pat. No. 3,546,328 discloses cospinning two polyamide compositions of different color from the same spinneret to form a yarn composed of filaments of one polyamide composition, filaments of the other polyamide composition, and side-by-side bicomponent filaments of both polyamide compositions. The yarn is said to be useful in the manufacture of fabrics in which a marl effect is required. British Pat. No. 1,130,996 discloses cospinning two different polyamides to form a yarn composed of low-shrinkage filaments of one polyamide, high shrinkage filaments of the other polyamide, and side-by-side bicomponent filaments of both polyamides. The yarn is knitted into stockings and crimped with steam to provide high stretchability with good surface smoothness.

Reese U.S. Pat. No. 3,998,042 discloses preparation of mixed-shrinkage, continuous-filament, heat-bulkable yarn, composed of low shrinkage and higher shrinkage polyester filaments, by cospinning two different polymer compositions under identical conditions. The polymer used for the low-shrinkage filaments consists of about 97 to 100 mole percent ethylene terephthalate structural units and about 3 to 0 mole percent of polymer structural units which contain sulfonate groups as pendant parts of repeating units in the polymer chain. The polymer used for the higher-shrinkage filaments consists of about 85 to 95 mole percent ethylene terephthalate structural units and about 15 to 5 mole percent of other ester units forming a copolyester therewith. The patent teaches that the break elongations of filaments of a yarn to be drawn should not differ by more than 15 percentage units so that the yarn can be drawn sufficiently without breaking filaments, since incompletely drawn segments cause uneven dyeing and harsh hand in fabrics made from the yarn. The patent discloses the use of higher relative viscosity polymer for the higher-shrinkage filaments than for the low-shrinkage filaments in order to provide nearly the same break elongations in the two types of filaments and yet produce a mixed-shrinkage yarn that develops high bulk in fabrics.

SUMMARY OF THE INVENTION

The present invention is a polyester feed yarn for drawtexturing, having an elongation at break of 30 to 150 percent, of filaments having deniers within the range of 2 to 8, and comprising three types of filaments, one of which is an eccentric bicomponent filament that can be broken preferentially in drawtexturing to provide a spun-like textured yarn having a slight, uniform protrusion of broken ends above the yarn or above the surface of fabric made from the textured yarn. The filaments are as follows:

(A) From 20 to 40 percent (based on the total number of filaments in the yarn) of the filaments consist of a polymer of about 97 to 100 mole percent ethylene terephthalate structural units and about 3 to 0 mole percent of polymer structural units which contain sulfonate groups as pendant parts of repeating units in the polymer chain. Any of the sulfonate-containing polymers disclosed in U.S. Pat. No. 3,998,042 are suitable for use in the yarn of the present invention.

(B) From 20 to 40 percent (based on the total number of filaments in the yarn) of the filaments consist of a polymer of about 85 to 95 mole percent ethylene terephthalate structural units and about 15 to 5 mole percent of other ester units forming a copolyester therewith. Any of the copolyesters disclosed in U.S. Pat. No. 3,998,042 for use in the higher-shrinkage filaments are suitable for use in the yarn of the present invention.

(C) From 15 to 35 weight percent (based on the total weight of the yarn) of the filaments consist of eccentric bicomponent filaments (side-by-side bicomponent filaments or eccentric sheath-core bicomponent filaments) wherein 20 to 80 percent of the filament cross section consists of a component having the same composition as type (A) above, and the remainder of cross section consists of a component having the same composition as type (B) above. The bicomponent filaments have an average denier smaller than any of the other filaments, have an elongation at break averaging less than 80 percent of the break elongation of any of the other filaments, and have the property of forming helical crimp when the filaments are hot-drawn and broken.

The two polymers used in forming the filaments can be chosen to provide different dyeability or coloration and give a worsted-like heather appearance in fabrics. For this purpose, type (A) filaments preferably consist of poly [ethylene terephthalate/5-(sodium sulfo) isophthalate] containing about 2 mole percent of the 5-(sodium sulfo)-isophthalate groups in the polymer chain, although any of the other sulfonate-containing copolymers disclosed in U.S. Pat. No. 3,998,042 are also suitable. The molecular weight of the polymer is preferably low enough to facilitate pill wear-off from fabrics without unduly lowering fabric abrasion resistance. Excellent results are obtained with sulfonate-containing copolymers having a relative viscosity (HRV) of 10 to 15.

When a difference in dyeability is not desired, type (A) filaments may consist of poly (ethylene terephthalate). This homopolymer preferably has a relative viscosity (HRV) of about 14 to 17.

The type (B) filaments preferably consist of poly (ethylene terephthalate/glutarate) or poly (ethylene terephthalate/adipate) or poly (ethylene/2,2-dimethyl-1,3-propylene terephthalate) containing about 8 to 13 mole percent of the glutarate or adipate or 2,2-dimethyl-1,3-propylene groups in the polymer chain. The relative viscosity (HRV) is preferably about 22 to 26. Higher values can result in poorer resistance to pilling in fabrics made from the yarn.

The preferred ranges of relative viscosities are also desirable for obtaining selective breakage of the bicomponent filaments because their resistance to breakage increases at higher HRV values.

The type (C) filaments preferably consist of 35 to 65 percent of a component having the same composition as the type (A) filaments and 65 to 35 percent of a component having the same composition as the type (B) filaments. Usually about equal proportions of the two components are used to develop maximum crimp on breaking of the bicomponent filaments. The denier per filament is preferably 40 to 65 percent of the denier per filament of the type (A) filaments.

DETAILED DESCRIPTION

Figure 1:
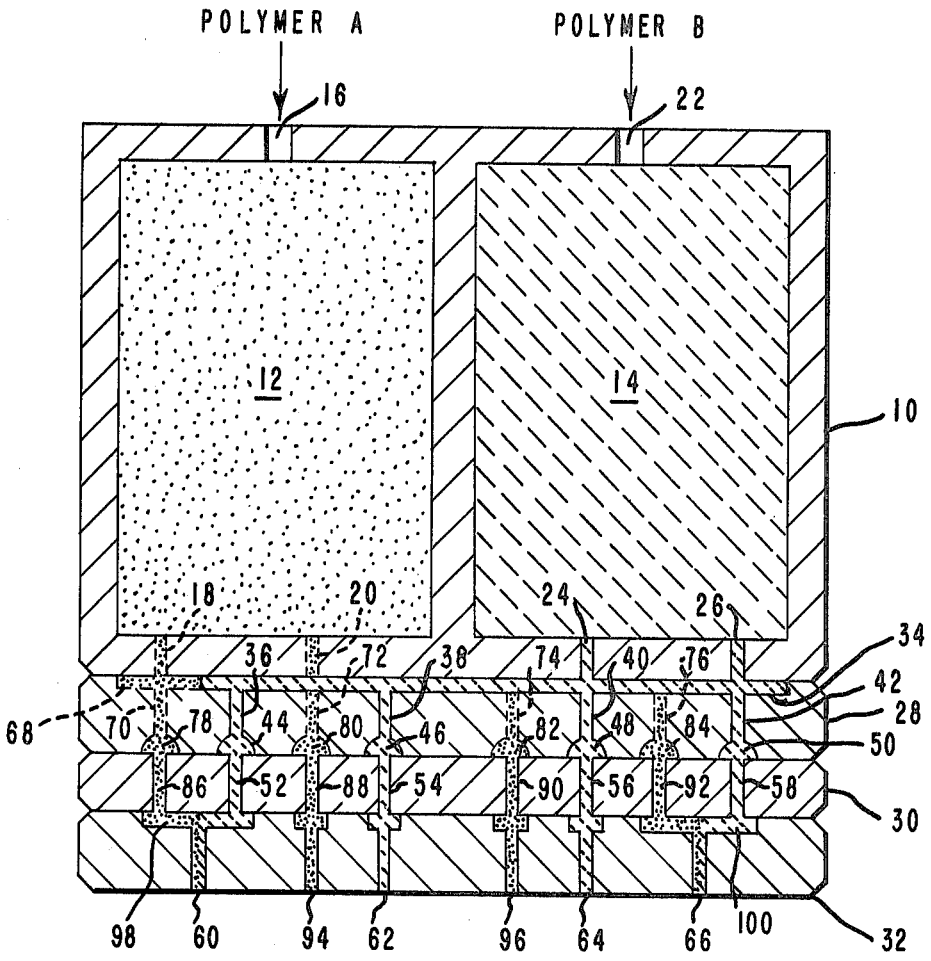
FIG. 1 is a schematic cross-sectional view of a spinning pack for producing three different types of filaments from polymers (A) and (B).

The spinning pack shown in FIG. 1 includes a filter holder, a distribution plate, a metering plate and a spinneret. The filter holder 10 is divided into two chambers 12 and 14. Polymer (A) is supplied to chamber 12 through opening 16 and leaves the chamber through openings 18 and 20. Polymer (B) is supplied to chamber 14 through opening 22 and leaves the chamber through openings 24 and 26. Distribution plate 28 distributes the polymers to capillary passageways through metering plate 30, which control the rate of polymer flow into spinneret orifices of plate 32. Distribution is accomplished by channels which run in one direction in the top face of the distribution plate and channels which run in a different direction, at right-angles to the above, in the bottom face of the distribution plate. As shown, polymer (B) flows from chamber 14 into a channel 34 cut in the top face of the distribution plate which extends from side-to-side in the plane of the cross section. The polymer then flows through opening 36, 38, 40 and 42 in the distribution plate to channels 44, 46, 48 and 50 cut in the bottom face of the plate in a direction perpendicular to the plane of the cross section shown. The polymer then flows through capillary passageways 52, 54, 56 and 58 in the metering plate, which supply polymer to spinneret orifices 60, 62, 64 and 66. In a similar way, polymer (A) flows from chamber 12 into a channel 68 cut in the top face of the distribution plate behind and parallel to channel 34. The polymer then flows through openings 70, 72, 74 and 76 to channels 78, 80, 82 and 84 cut in the bottom face of the distribution plate between and parallel to the channels for polymer (B). Polymer (A) then flows through capillary passageways 86, 88, 90 and 92 in the metering plate, which supply polymer to spinneret orifices 60, 94, 96 and 66. Channels 98 and 100 in the top face of the spinneret supply the two polymers side-by-side to spinneret orifices 60 and 66 to form bicomponent filaments. Filaments of polymer (B) are produced at spinneret orifices 62 and 64, and filaments of polymer (A) are produced at orifices 94 and 96.

Figure 2:
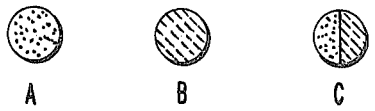
FIG. 2 illustrates cross sections of the three types of filaments produced.

As shown in the greatly enlarged filament cross sections of FIG. 2, the filaments of FIG. 2A consist of one polymer, the filaments of FIG. 2B consist of the other polymer, and the side-by-side bicomponent filaments of FIG. 2C consist of about equal proportions of the two polymers.

The distribution plate will usually have 6 to 12 channels on the top face and 6 to 12 channels on the bottom face. In subsequent Example 1 a distribution plate is used which has six alternating channels on each face, three for poly[ethylene terephthalate/5-(sodium sulfo)isophthalate] and three for poly(ethylene terephthalate/glutarate). These channels supply a metering plate having 66 capillary passageways. Fifteen capillaries are used to meter one polymer to spinneret orifices used for producing single component filaments of that polymer and fifteen capillaries are used to meter the other polymer to orifices used for producing the other single component filaments. Smaller diameter capillaries are used to meter the polymers to orifices used for producing bicomponent filaments, 18 orifices for metering one polymer and another 18 for metering the other polymer.

The metering plate is not always needed. In certain cases the absence of a metering plate will not affect the ratio of the two polymers in cross sections of the bicomponent filaments. In other cases the absence of a metering plate will result in non-uniform distribution of the ratio of one polymer to the other polymer in bicomponent filaments of the yarn produced whereas non-uniformity is readily avoided by using a metering plate.

The filaments are melt-spun and stretched under conditions which provide a yarn having an elongation at break of 30 to 150 percent that is composed of filaments having deniers within the range of 2 to 8, so that the yarn can be drawtextured at a low draw ratio (usually about 1.1 to 2.0 draw ratio) to provide a spun-like textured yarn. The filaments are produced under conditions which provide bicomponent filaments having an elongation at break which is less than 80 percent of the break elongation of any of the other filaments, so that the bicomponent filaments can be broken preferentially when the yarn is drawtextured. Suitable break elongations for the yarn and for the bicomponent filaments can be provided by cospinning filaments at windup speeds of 2600 to 5000 meters per minute to produce a yarn composed of filaments as characterized below. Stretching of the filaments during spinning is preferably accomplished by pulling the filaments away from the spinneret at high speed and then feeding them to the windup without additional stretching, as disclosed in Petrille U.S. Pat. No. 3,771,307 for spinning poly(ethylene terephthalate) homofilaments.

The yarn of the present invention is prepared by melt-spinning two polymers, polymer (A) and polymer (B), to produce filaments of polymer (A), filaments of polymer (B), and eccentric bicomponent filaments composed of both polymers (A) and (B). Polymer (A) can be poly(ethylene terephthalate), but it is usually modified with up to 3 mole percent of polymer structural units which contain sulfonate groups as pendant parts as disclosed in U.S. Pat. No. 3,998,042. These modifying units impart cationic dyeability which is desirable for providing heather effects in fabrics made from the yarn. Polymer (A) preferably consists of poly[ethylene terephthalate/5-(sodium sulfo)isophthalate] containing about 2 mole percent of the 5-(sodium sulfo)isophthalate groups in the polymer chain. This polymer can readily be spun into filaments having a relative viscosity (HRV) of 10 to 15, which provides excellent pilling resistance in fabrics made from the yarn. Poly(ethylene terephthalate) is difficult to spin at such low relative viscosities without using a melt viscosity builder, so polymer of about 14 to 17 relative viscosity (HRV) is used instead.

Polymer (B) consists of a polymer of about 85 to 95 mole percent ethylene terephthalate structural units and about 15 to 5 mole percent of other ester units forming a copolyester therewith, such as the copolyesters disclosed in U.S. Pat. No. 3,998,042 for use in the higher-shrinkage filaments. Polymer (B) preferably consists of poly(ethylene terephthalate/glutarate) or poly(ethylene terephthalate/adipate) or poly(ethylene/2,2-dimethyl-1,3-propylene terephthalate) containing about 8 to 13 mole percent of the glutarate or adipate or 2,2-dimethyl-1,3-propylene groups in the polymer chain. These polymers can readily be spun into filaments having a relative viscosity (HRV) of about 22 to 26 to provide excellent pilling resistance in fabrics made from the yarn. Higher relative viscosity values can result in poorer resistance to pilling and lower values are difficult to spin. The copolyester can include ester units which contain pendant sulfonate groups to impart cationic dyeability as described above, in which case a relative viscosity of 14 to 17 will provide melt viscosities that are easier to spin. Deflection of the bicomponent filaments at the spinneret face is avoided when the melt viscosities of polymer (A) and (B) are sufficiently close.

The bicomponent filaments are designed to break preferentially in drawtexturing and then helically crimp to provide spun-like tactility with uniform broken ends which protrude less than 2.5 millimeters above the surface of the yarn or the surface of fabric made from the yarn. The filaments can be broken to generate greater than two broken filaments per centimeter without producing undesirable broken filament clumps. The number of broken filaments varies with (a) the weight ratio of the two components in the bicomponent filaments, (b) the denier per filament of the bicomponent filaments, (c) the number of bicomponent filaments in the yarn, and (d) the draw ratio used in drawtexturing. Tactility can be varied from cotton-like (high number of broken filaments and low average denier per filament in the yarn) to wool-like (low number of broken filaments and high average denier per filament in the yarn).

The eccentric bicomponent filaments preferably consist of polymers (A) and (B) adhered side-by-side, although an eccentric sheath-core arrangement can be used. The proportion of the two polymers is such that the bicomponent filament cross section contains at least 20 percent of each of the two components. When the yarn is drawtextured and made into fabric, it is desirable that the broken filament ends protrude to a minimum which contributes to spun-like tactility but not to pilling. Better resistance to pilling is provided by ends that protrude less than 1.5 millimeter above the fabric surface. Broken bicomponent filaments with less than 20 percent of either of the components do not crimp sufficiently when broken in drawtexturing and consequently protrusion of broken ends above the fabric surface is greater than 1.5 mm. Preferably the bicomponent filaments consist of 35 to 65 weight percent of polymer (A) and 65 to 35 percent of polymer (B). Usually about an equal proportion of the two components is used to achieve maximum crimp on breaking. The desired proportion of components can be accomplished by choice of relative viscosities and appropriate design of the metering plate capillaries.

The bicomponent filaments have a lower elongation at break than the other filaments so that they will break preferentially during drawtexturing of the yarn. For this purpose the bicomponent filaments have a break elongation averaging less than 80 percent of the break elongation of any of the other filaments. Where single component filaments break, they either strip back in the yarn to form a clump or protrude too high above fabric surfaces and give poor pilling performance. Lower break elongation can be provided by making the bicomponent filaments of smaller denier per filament than the other filaments by selection of suitable capillary sizes in the metering plate and/or the spinneret orifices. In general, the homofilaments of polymer (A) will have a lower break elongation than the homofilaments of polymer (B), when the filaments are produced under the same conditions, and the denier per filament of the bicomponent filaments is preferably 40 to 65 percent of the denier per filament of the homofilaments of polymer (A).

The yarn contains 15 to 35 weight percent of the bicomponent filaments, based on the total weight of the yarn. The yarn can be drawtextured to provide greater than two broken filaments per centimeter, without breaking the single component filaments, by adjusting the draw ratio used in the drawtexturing operation. This draw ratio can be from about 1.1 to 2.0 when the yarn has an elongation at break of 30 to 150 percent and the bicomponent filaments have the lower break elongation indicated. Preferably, the yarn is designed for drawtexturing at a draw ratio of 1.6 to 1.9. From 20 to 40 percent of the filaments in the yarn may consist of single component filaments of polymer (A) and 20 to 40 percent of the filaments may consist of single component filaments of polymer (B). Usually about an equal proportion of the two types of single component filaments is used.

EXAMPLE 1

A polyester feed yarn for drawtexturing is melt-spun from polymers (A) and (B), using a spinneret pack of the type described containing a distribution plate, a metering plate and a spinneret with a rectangular array of 48 cylindrical orifices. The 30 metering plate capillaries for single component filaments are 0.508 mm in diameter by 4.775 mm in length (20×188 mils). For the bicomponent filaments, 18 capillaries for polymer (A) are 0.33×4.775 mm (13×188 mils) and 18 capillaries for polymer (B) are 0.381×4.775 mm (15×188 mils). The cylindrical spinneret orifices are 0.279×0.838 mm (11×33 mils) for single component filaments and 0.381×1.524 mm (15×60 mils) for bicomponent filaments. The block temperature is 290°–295° C. The filaments are cooled by cross-flow air quench as they are pulled away from the spinneret by a feed roll having a surface speed of 3200 meters per minute, are interlaced on the machine with a fluid jet to an average spacing of 20 cm between interlace nodes, and pass to a windup at 3200 mpm.

Polymer (A) is poly[ethylene terephthalate/5-(sodium sulfo)isophthalate] of 13±0.1 relative viscosity (HRV), containing 2 mole percent 5-(sodium sulfo)isophthalate groups in the polymer chain. Polymer (B) is poly(ethylene terephthalate/glutarate) of 24±0.2 HRV, containing 12 mole percent glutarate groups in the polymer chain. The resulting feed yarn has a denier of 240 and consists of 15 filaments of polymer (A) having a denier per filament of 6.3, 15 filaments of polymer (B) having a denier per filament of 5.0, and 18 component filaments of 36 percent polymer (A): 64 percent polymer (B), having a denier per filament of 3.9. The bicomponent filaments have a break elongation of 83 percent, the filaments of polymer (A) have a break elongation of 120 percent, and the filaments of polymer (B) have a break elongation of 133 percent.

The polyester feed yarn is drawtextured at 1.7 draw ratio on a Leesona ® 955 false-twist texturing machine, using a throughput of 90 meters per minute, a twist of 2360 turns per meter and a heater temperature of 190° C. The drawtextured yarn has 2.7 broken filament ends per centimeter. Greater than 99 percent of the broken filament ends are bicomponent filaments. The yarn is then knitted into tubing on a Lawson-Hemphill knitter and dyed with cationic dye. Dyed, knit tubings of the drawtextured yarn show a heather appearance with wool-like tactility. Broken filament ends protrude less than 1.5 millimeters above the fabric surface. The Random Tumble Pill Test (RTPT) gives ratings of 4.3 after 30 minutes and 4.5 after 60 minutes, indicative of very good resistance to pilling.

EXAMPLE 2

Example 1 is repeated except that poly[ethylene terephthalate/5-(sodium sulfo)isophthalate] of different relative viscosities (HRV) and different draw ratios (DR) are used. The deniers per filament and differences in break elongations of filaments in the feed yarns are substantially the same as in Example 1. The broken filament ends (BFE) per centimeter in the drawtextured yarns and the pilling ratings (PR) in 30 minute tests of the fabrics are as follows:

| Run | HRV | DR | BFE | PR |
|---|---|---|---|---|
| (a) | 11.9 | 1.65 | 2.0 | 3.3 |
| (b) | 13.5 | 1.7 | 4.7 | 2.3 |
| (c) | 14.0 | 1.65 | 2.5 | 3.3 |

The broken filament ends protrude less than 1.5 mm above the fabric surface of dyed, Lawson-knit tubings in each run. The improved pilling ratings in Runs (a) and (c) are attributed to the lower number of broken filament ends per centimeter as compared to Run (b).

EXAMPLE 3

A 240 denier feed yarn, consisting of 12 filaments of polymer (A) having a denier per filament of 7.6, 12 filaments of polymer (B) having a denier per filament of 5.5, and 18 bicomponent filaments having a denier per filament of 4.7, is prepared by the general procedure of Example 1 but without using a metering plate. The polymers differ from those of Example 1 only in that polymer (A) has 12.8 HRV and polymer (B) has 22.0 HRV. The ratio of polymer (A):polymer (B) in the bicomponent filaments is 35:65. The bicomponent filaments have a break elongation of 108 percent, the filaments of polymer (A) have a break elongation of 136 percent, and the filaments of polymer (B) have a break elongation of 151 percent. After drawtexturing at 1.7 draw ratio the yarn has 2.5 broken filament ends per centimeter. Greater than 99 percent of the broken filament ends are bicomponent filaments. Cationic dyed, Lawson-knit tubing of this drawtextured yarn has a heather appearance with "bity" wool-like tactility. Broken ends protrude less than 1.5 mm above the fabric surface. Excellent resistance to pilling is indicated by RTPT ratings of 4.5 after 30 minutes and 5.0 after 60 minutes.

EXAMPLE 4 (Comparative)

A 240 denier feed yarn, consisting of 12 filaments of polymer (A) having a denier per filament of 6.0, 24 filaments of polymer (B) having a denier per filament of 4.7, and 24 bicomponent filaments having a denier per filament of 2.6, is prepared by the general procedure of Example 1 but without using a metering plate. The polymers are essentially the same as in Example 3. The bicomponent filaments have an average break elongation of 112 percent, the filaments of polymer (A) have a break elongation of 134 percent, and the filaments of polymer (B) have a break elongation of 153 percent. After drawtexturing at 1.7 draw ratio the yarn has 7.0 broken filament ends per centimeter. Cationic dyed, Lawson-knit tubing of this drawtextured yarn has a worsted-like heather with soft, cotton-like tactility. The protrusion of broken ends above the fabric surface varies from 1.0 mm to greater than 2.5 mm. The average ratio of polymer (A):polymer (B) in the low denier per filament bicomponent filaments is 81:19 with a distribution varying from 60:40 to substantially 100:0. The higher protruding broken ends result from filaments having a ratio of 90:10 or more which do not crimp or become entangled sufficiently. These ends tends to strip back and form clumps in processing. This non-uniform distribution of polymers can be avoided by use of a metering plate. RTPT ratings of 1.0 after 30 minutes and 4.3 after 60 minutes are obtained.

EXAMPLE 5

Polyester feed yarns for drawtexturing are melt-spun from two polymers, using a spinneret pack of the type described containing a distribution plate, a metering plate and a spinneret with a rectangular array of 68 cylindrical orifices. The 48 metering plate capillaries for single component filaments are 0.381 mm in diameter by 4.775 mm in length (15×188 mils). The 40 metering plate capillaries used for forming bicomponent filaments are 0.304×4.775 mm (12×188 mils). The cylindrical spinneret orifices are 0.381×1.524 mm (15×60 mils). The block temperature is 290° C. The filaments are cooled by cross-flow air quench as they are pulled away from the spinneret by a feed roll having a surface speed of 940 meters per minute. The filaments are pulled from the feed roll through a steam jet supplied with 235° C. steam at 5.78 atmospheres gauge pressure and pass to a windup at 3200 meters per minute.

Polymer (A) is poly[ethylene terephthalate/5-(sodium sulfo)isophthalate] of about 13.5 HRV, containing 2 mole percent 5-(sodium sulfo)isophthalate groups in the polymer chain. Polymer (B) is poly(ethylene terephthalate/glutarate of 23 HRV, containing 12 mole percent glutarate) groups in the polymer chain (2G-T/2G-5), or poly(ethylene terephthalate/adipate) of 26 HRV, containing 12 mole percent adipate groups in the polymer chain (2G-T/2G-6), or poly(ethylene/2,2-dimethyl-1,3-propylene terephthalate) of 22.0 HRV, containing 10 mole percent 2,2-dimethyl-1,3-propylene groups in the polymer chain (2G-T/DiMe3G-T). The resulting feed yarn has a denier of 150 and consists of 24 filaments of polymer (A) having a denier per filament of about 3, 24 filaments of polymer (B) having denier per filament of about 3, and 20 bicomponent filaments having a denier per filament of about 2. The ratio of polymer (A):polymer (B) in the bicomponent filaments is substantially 50:50.

The polyester feed yarn is drawtextured on a Leesona® 955 false-twist texturing machine, using a throughput of 90 meters per minute, a twist of 2360 turns per meter and a heater temperature of 190° C. The draw ratio (D.R.) used, and evaluation of the product for broken filament ends (BFE) and protrusion of ends above the surface of Lawson knit tubes are given in the following table:

| Polymer (B) Composition | D.R. Used | BFE/cm Count | Protrusion Above Fabric Surface |
|---|---|---|---|
| 2G-T/2G-5 | 1.10× | 3.1 | Less than 1.5 mm |
| 2G-T/2G-6 | 1.09× | 6.7 | Less than 1.2 mm |
| 2G-T/DiMe3G-T | 1.03× | 0.4 | Less than 1.5 mm |

The tactility of the first two items is soft and cotton-like. The third item is drawtextured at such a low draw ratio that an insufficient number of broken filament ends per centimeter are obtained and the product lacks spun-like tactility.

TEST METHODS

Relative viscosity (HRV) is the ratio of the viscosity of a solution of 0.78 gram of a polyester, dissolved in 10 ml of hexafluoroisopropanol containing 100 ppm $H_2SO_4$, to the viscosity of the $H_2SO_4$-containing hexafluoroisopropanol itself, both measured at 25° C. in a capillary viscosimeter and expressed in the same units.

Break elongation of a specimen is measured on an Instron Tensile Testing Machine, using an initial length of 5 inches (12.7 cm) and a rate of elongation of 200 percent per minute. In other respects the test is as described in ASTM D 2256-75.

Random Tumble Pilling Test (RTPT) is conducted in accordance with ASTM test D 1375-72, which has been approved as an American National Standard test by the American National Standard Institute. A Random Tumble Pilling Tester available from the Atlas Electric Devices Company, Chicago, Ill., is used for the test. The Tester uses cork-lined cylindrical chambers, 5.75 inch (146 mm) in diameter by 7.81 inch (198 mm) long, in which fabric specimens are tumbled by rotating impellers, 4.75 inch (121 mm) long and centered to provide 0.50 inch (12.7 mm) clearance between the impeller end and the chamber wall. The specimens and small amounts of short length cotton fiber are tumbled in a random rubbing motion to form pills that resemble those produced in actual wear in appearance and structure.

Three specimens 4.19 inch by 4.19 inch (105×105 mm) are cut at 45° angle to the wale from each fabric sample to be tested. The edges of the specimens are sealed by applying a strip of cement no more than ⅛-inch (3.2 mm) wide. After drying, the three specimens and about 25 mg of about 0.2 inch (5 mm) length cotton sliver are tumbled in a chamber for 30 minutes. The specimens are then removed from the chamber, excess lint is removed by vacuum, and the specimens are evaluated for the extent of pilling. The specimens and about 25 mg of cotton sliver are returned to the chamber and tumbled for an additional 30 minutes. The specimens are again freed of excess lint and evaluated for the extent of pilling after the total of 60 minutes of tumbling. The specimens are evaluated under a desk lamp for resistance to pilling, using the following scale:

5—Excellent (no pilling)
4—Good (slight pilling)
3—Medium (moderate pilling)
2—Poor (heavy pilling)
1—Very poor (severe pilling)

A set of five photographs for RTPT rating of specimens is available from ASTM Headquarters, Philadelphia, Pa.

Crimp frequency in broken filaments is used to characterize a property of the disclosed bicomponent filaments that is responsible for the slight, uniform protrusion of broken filament ends obtained in spun-like products produced from the feed yarn of this invention. The test includes (a) hot drawing of the feed yarn without false-twist texturing it, (b) separation of the individual filaments of the yarn, (c) breaking the separated filaments, and (d) determining the crimp frequency at 2 to 3 cm from the broken end of each filament.

(a) The feed yarn is hot drawn on a Leesona® 955 drawtexturing machine with the yarn by-passing the false-twist spindle. The heater temperature is 190° C. A draw ratio is used which does not break filaments but which is substantially the same as that used when the feed yarn is drawtextured; e.g., 1.6 draw ratio for the feed yarns of Examples 1 to 3.

(b) A 25 cm length is cut from the drawn feed yarn, and the filaments are separated and numbered.

(c) The filaments are broken in sequence on an Instron Tensile Testing Machine, using an initial length of 12.7 cm, a cross head speed of 12.7 cm/minute and a chart speed of 50.8 cm/minute. In other respects the procedure is as described in ASTM D 2101-72.

(d) Crimp frequency is determined for the broken filaments in the same sequence as above. Adhesive tape is used to attach a filament segment at top and bottom to a clear, plastic straight-edge, so that the filament is in a relaxed condition on the straight-edge. Using a Shadowgraph and about 20× magnification the number of full cycles of crimp in the segment of filament are counted. The extended length of the same filament segment is then measured under a load sufficient to straighten but not stretch the segment, e.g., a 0.6 g weight for 2 to 6 dpf filaments. The crimp frequency is the number of crimps divided by the extended length. In single component filaments crimp is concentrated within 2 to 3 cm of the break site. In bicomponent filaments crimp is spread along the whole filament, and crimp which develops after hot drawing and relaxing increases after breaking on the tensile testing machine. For comparative purposes the crimp frequency is determined over a length of 2 to 3 cm from the break site on all filaments.

The different types of filaments in the drawn feed yarn are readily distinguished by the break elongation and breaking strength values obtained on the tensile testing machine. The bicomponent filaments have the lowest values and the single component filaments of polymer (B) have the highest values. The filaments can also be distinguished by dyeing with cationic dyes to show differences in dyeability. Results obtained with the polymers of Example 1 are shown in the following table:

| | Avg. Fil. Bk.Elong., % | | | Avg. Fil. Breaking Strength (gms) | | | Ratio of | Crimp Frequency/cm | | |
|---|---|---|---|---|---|---|---|---|---|---|
| Denier-Filament | A | B | C | A | B | C | A:B | A | B | C |
| 240-48 (1.6 DR) | 29 | 41 | 13 | 11.1 | 13.7 | 4.6 | 40:60 | 1.9 | 2.4 | 3.5 |
| 270-48 (1.65 DR) | 24 | 37 | 10 | 12.8 | 14.9 | 4.7 | 35:65 | 1.5 | 2.4 | 3.4 |
| 240-60 (1.6 DR) | 31 | 43 | 28 | 9.8 | 11.9 | 5.3 | 18:82 | 1.3 | 2.4 | 1.3 |

The first two items are feed yarns of this invention. The bicomponent filaments have higher crimp frequencies than each of the other filaments. In general the bicomponent filaments of yarns of this invention will have crimp frequncies greater than 2.5 per cm when tested as described, and the crimp is spread along the whole filament. The third item is not a feed yarn of this invention. The crimp frequency is less than 2.5 per cm and is not greater than that of the other filaments. Bicomponent filaments having less than 20 percent of one component do not develop sufficient crimp.

The protruded broken filament ends in Lawson knit tubings are measured by the following method. An approximately 25 cm. panel is folded perpendicular to the direction of the courses and placed under a magnifying lens so that protruding broken ends that stick out are measured along the folded end. The measurments are repeated along two more folded edges and averaged. The number of broken-end readings is usually greater than 60.

Interlace in yarn is measured with the Du Pont Automatic Pin Drop Counter disclosed in Gray U.S. Pat. No. 3,563,021 at column 7, lines 23-30. The hysteresis brake is set at position 9 to apply tension on the yarn being tested. Ten readings are made on each of five different portions of the yarn and the 50 readings are averaged.

I claim:

1. A polyester feed yarn for drawtexturing, having an elongation at break of about 30 to 150 percent, of filaments having deniers within the range of 2 to 8, and comprising the following types of filaments:

(A) 20 to 40 percent (based on the total number of filaments) of filaments consisting of a polymer of about 97 to 100 mole percent ethylene terephthalate structural units and about 3 to 0 mole percent of polymer structural units which contain sulfonate groups as pendant parts of repeating units in the polymer chain, (B) 20 to 40 percent (based on the total number of filaments) of filaments consisting of a polymer of about 85 to 95 mole percent ethylene terephthalate structural units and about 15 to 5 mole percent of other ester units forming a copolyester therewith, and (C) 15 to 35 weight percent (based on the total weight of the yarn) of eccentric bicomponent filaments wherein 20 to 80 percent of this filament cross section consists of a component having the same composition as type (A) and the remainder of the cross section consists of a component having the same composition as type (B); the bicomponent filaments having an average denier smaller than any of the other filaments, an elongation at break averaging less than 80 percent of the break elongation of any of the other filaments, and the property of forming helical crimp when the filaments are hot drawn and broken.

2. The polyester feed yarn defined in claim 1 wherein the type (A) filaments consist of poly[ethylene terephthalate/5-(sodium sulfo)-isophthalate] containing about 2 mole percent of the 5-(sodium sulfo) isophthalate groups in the polymer chain.

3. The polyester feed yarn defined in claim 2 wherein the type (A) filaments have a relative viscosity of 10 to 15.

4. The polyester feed yarn defined in claim 2 wherein the type (B) filaments consist of poly(ethylene terephthalate/glutarate) containing about 8 to 13 mole percent of the glutarate groups in the polymer chain and having a relative viscosity of about 22 to 26.

5. The polyester feed yarn defined in claim 2 wherein the type (B) filaments consist of poly(ethylene terephthalate/adipate) containing about 8 to 13 mole percent of the adipate groups in the polymer chain and having a relative viscosity of about 22 to 26.

6. The polyester feed yarn defined in claim 2, wherein the type (B) filaments consist of a polymer having a relative viscosity of about 22 to 26 and of about 87 to 92 mole percent ethylene terephthalate structural units and about 8 to 13 mole percent of 2,2-dimethyl-1,3-propylene terephthalate structural units forming a copolyester therewith.

7. The polyester feed yarn defined in claim 2 wherein the type (C) filaments consist of 35 to 65 percent of a component having the same composition as the type (A) filaments and 65 to 35 percent of a component having the same composition as the type (B) filaments.

8. The polyester feed yarn defined in claim 7 wherein the denier per filament of the type (C) filaments is 40 to 65 percent of the denier per filament of the type (A) filaments.

* * * * *